US009234147B2

(12) United States Patent
Von Kossak-Glowczewski

(10) Patent No.: US 9,234,147 B2
(45) Date of Patent: Jan. 12, 2016

(54) GASIFICATION REACTOR AND PROCESS

(75) Inventor: Thomas Paul Von Kossak-Glowczewski, Gummersbach (DE)

(73) Assignee: Shell Oil Company, Houston, TX (US)

( * ) Notice: Subject to any disclaimer, the term of this patent is extended or adjusted under 35 U.S.C. 154(b) by 510 days.

(21) Appl. No.: 13/574,642

(22) PCT Filed: Jan. 25, 2011

(86) PCT No.: PCT/EP2011/050986

§ 371 (c)(1),
(2), (4) Date: Jul. 23, 2012

(87) PCT Pub. No.: WO2011/089268

PCT Pub. Date: Jul. 28, 2011

(65) Prior Publication Data

US 2012/0292573 A1 Nov. 22, 2012

(30) Foreign Application Priority Data

Jan. 25, 2010 (EP) ..... 10151517

(51) Int. Cl.

| | |
|---|---|
| ***C10J 3/82*** | (2006.01) |
| ***C10J 3/48*** | (2006.01) |
| ***C10J 3/52*** | (2006.01) |
| ***C10J 3/84*** | (2006.01) |

(52) U.S. Cl.

CPC *C10J 3/485* (2013.01); *C10J 3/526* (2013.01); *C10J 3/82* (2013.01); *C10J 3/845* (2013.01); *C10J 2200/152* (2013.01); *C10J 2300/093* (2013.01)

(58) Field of Classification Search

CPC ..... C10J 3/82; C10J 3/485; C10J 3/526; C10J 3/845; C10J 2300/093; C10J 2200/152

USPC ..... 48/61

See application file for complete search history.

(56) References Cited

U.S. PATENT DOCUMENTS

| | | | | |
|---|---|---|---|---|
| 4,731,097 | A * | 3/1988 | Kohnen et al. | 48/76 |
| 4,859,213 | A | 8/1989 | Segerstrom | 48/87 |
| 4,973,337 | A * | 11/1990 | Jokisch et al. | 48/87 |
| 5,803,937 | A * | 9/1998 | Hartermann et al. | 48/210 |
| 2008/0000155 | A1 | 1/2008 | Van Den Berg et al. | 48/208 |
| 2009/0133328 | A1 * | 5/2009 | Van Den Berg et al. | 48/87 |

FOREIGN PATENT DOCUMENTS

| | | | |
|---|---|---|---|
| DE | 3601786 | 7/1987 | F28B 3/04 |
| EP | 0347986 | 12/1989 | C10J 3/84 |
| EP | 0870818 | 10/1998 | C10J 3/46 |

* cited by examiner

*Primary Examiner* — Matthew Merkling

(57) ABSTRACT

A gasification reactor (1) and a process for the production of syngas by gasification of a carbonaceous feed. The reactor comprises a gasifier unit with a discharge channel (4) for discharging a stream of slag-loaded hot syngas and a quencher (5) for supplying a flow of quench gas into the discharge channel (4). At least one blaster (10) is arranged comprising at least one blast nozzle (12), such as a blast lance, in line with the flow direction of the quench gas. The blaster (10) can be connected to a source of pressurized gas, such as syngas, nitrogen, carbon dioxide, steam or the like. The blaster can be actuated periodically to blast away slag deposits.

20 Claims, 3 Drawing Sheets

GASIFICATION REACTOR AND PROCESS

PRIORITY CLAIM

The present application claims priority from PCT/EP2011/050986, filed 25 Jan. 2011, which claims priority from EP 10151517.9, filed 25 Jan. 2010.

The present invention relates to a gasification reactor and a process for the production of syngas by gasification of a carbonaceous feed, wherein the reactor comprises a gasifier unit with a discharge channel for discharging a stream of slag-loaded hot syngas and a quencher for supplying a flow of quench gas into the discharge channel.

In gasification processes for the production of synthetic gas, or syngas, carbonaceous feedstock, such as pulverized coal, is partially oxidised in a reactor. Initially, the syngas typically has a temperature of 1300-1600° C. The hot syngas contains liquid slag droplets. In order to avoid fouling on the heat exchangers, it is necessary to solidify the liquid slag droplets that are entrained in the gas leaving the gasifier, and to cool the liquid slag droplets to a temperature at which they are not sticky. This means that the entire gas stream leaving the gasifier must be cooled to a temperature that is well below the slag softening temperature. To this end, the hot syngas leaving the reactor is quenched to temperatures between 1000-700° C. by feeding back cleaned and cooled syngas into the gas stream before it is transported to one or more heat exchangers. This recycled cooled gas is generally referred to as quench gas.

EP 0 347 986 A1 discloses an interchangeable quench gas injection ring with nozzles injecting cooled and recycled gas into the raw gas product as it leaves the reactor. The recycled cooled gas should be mixed into the hot syngas uniformly and a film of cool gas should be formed adjacent the wall where the supply line of the quench gas exits into the gas stream.

In operation, the hot syngas stream, typically flowing in upward direction, forms stalagmites and vertical upstanding beards of deposited slag where it is mixed with the cooled recycled gas. These slag deposits disturb the gas flow. If these deposits grow too large, the desired cool gas film cannot be obtained anymore and the cooled gas is mixed unevenly within the hot gas flow.

The object of the invention is to provide an effective way to prevent large slag deposits at the point where the quench gas is mixed into the hot gas flow.

The object is achieved with a gasification reactor for the production of syngas by gasification of a carbonaceous feed, wherein the reactor comprises a discharge channel for discharging a stream of slag-loaded hot syngas and a quencher for supplying a flow of quench gas into the discharge channel, wherein at least one blaster is arranged comprising at least one blast nozzle in line with the flow direction of the quench gas.

This way, slag deposits can effectively be removed by activating the blaster. Since the blast nozzle is in line with the flow direction of the quench gas, it is able to blast away slag deposits possibly hindering the quench gas flow. It does not mean that the blast direction must be strictly parallel to the quench flow direction.

The at least one blaster can for example be connected to a source of pressurized blast gas selected from the group of syngas, nitrogen, carbon dioxide, steam and mixtures thereof.

In a particular embodiment, the blaster is divided into a plurality of compartments, each comprising one or more blast lances, whereby an even number of opposite compartments is operated symmetrically to mitigate the blast impulse into the center of the discharged syngas stream. The blaster can for example be divided into 4-16 compartments, for example 8 compartments, each compartment comprising a number of blast lances. By activating two opposite blaster compartments, symmetrical blasting can be achieved without the need to activate all blast lances simultaneously.

The slag beards typically grow on the upper peripheral edge of the gasifier unit where it opens into the gas discharge channel and where the hot syngas is quenched with the cool quench gas in a quench area. The quench area typically has a bottom sloping downwardly in the direction of the opening and making an acute angle with the horizontal, resulting in a sharp peripheral edge between the reactor and the quench area. If the blasted slag beards leave some remaining slag deposit on this peripheral edge, these residual deposits can initiate growth of new slag beards. In order to hinder this, the slag deposits should preferably be blasted away completely without leaving any residue. To this end, the blaster can be directed to this upper peripheral edge of the reactor. The blaster is preferably directed to blast under a blast angle which is 0.1-5 degrees steeper than the flow direction of the quench gas, which is substantially parallel to the sloping bottom of the quench area.

For effective cleaning, the blaster can comprise a number of blast lances extending in the radial direction of the discharge channel with an angle of 1-3 degrees between adjacent lances.

The at least one blaster can for instance be operated periodically. In order to blast the blast gas with optimum velocity, the pressure of the blast gas can, e.g., be kept 10-100 bar higher than the pressure of the discharged syngas. The gas can be blasted into the quench area with a velocity of, for example, 30-300 m/s.

To keep the blast nozzles open and free the blasters can be operated to release a continuous purge flow in addition to the periodically released blast flow. This also has the advantage that the blaster tips are cooled and protected against heat radiation from the syngas.

An exemplary embodiment of the invention will now be described by reference to the accompanying drawing, in which.

Figure 1:
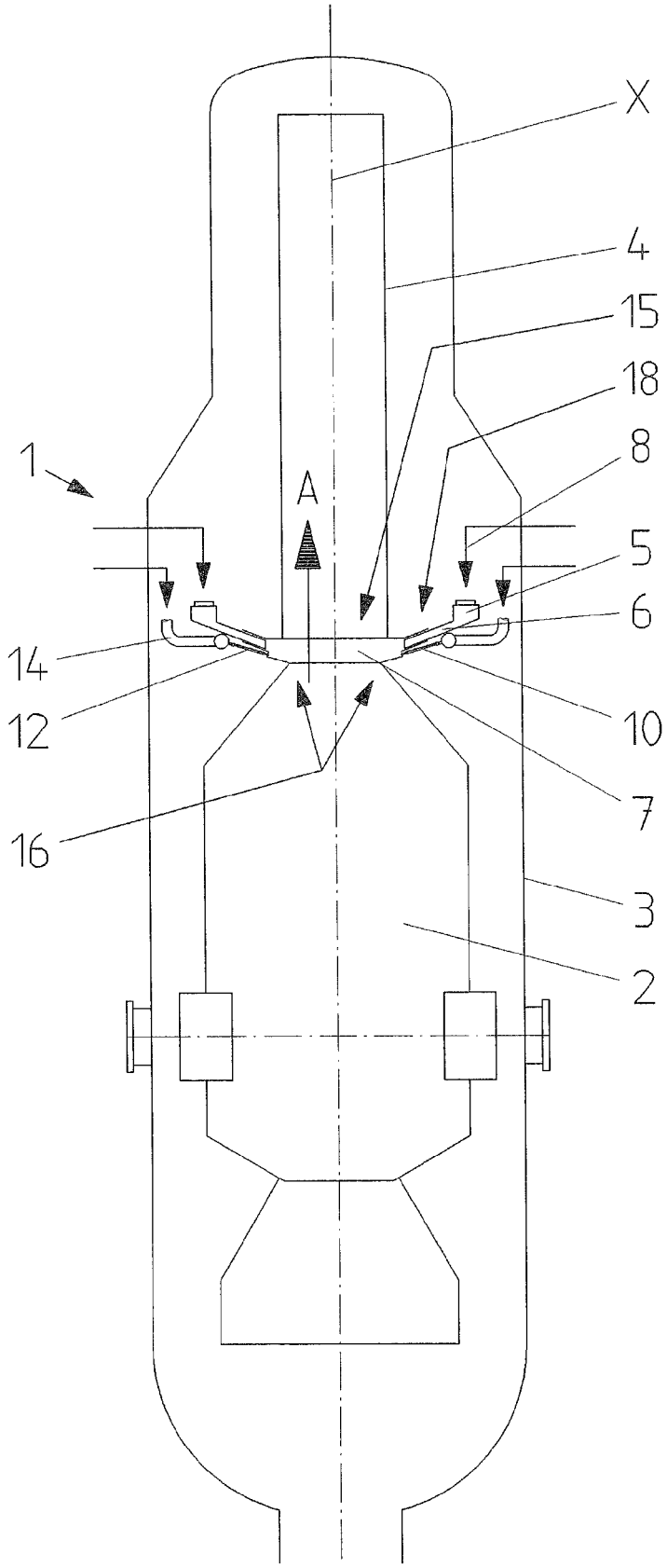
FIG. 1 shows schematically a longitudinal cross section of a gasification reactor according to the present invention.

The gasification reactor 1 shown in FIG. 1 comprises a gasifier unit 2 in a vertically oriented elongated pressure container 3. The gasifier unit 2 is supplied with a carbonaceous feed, for example pulverized coal, which is partially combusted by a number of burners (not shown) in the gasifier unit 2 to form syngas. At its top end the gasifier unit 2 comprises an opening 15 which opens into a quench area 18. The quench area 18 has a slightly sloping bottom 19 around the opening 15 forming an acute upper peripheral edge 16. The quench area 18 forms the beginning of a discharge channel 4. In the quench area 18 a quench gas supply unit 5 is arranged to mix cool quench gas into the stream A of discharged hot syngas to cool down the syngas to below the softening point of the slag particles carried by the discharged syngas. Quenched syngas flows from the quench gas supply unit 5 in quench gas flow direction B (see FIG. 2) into the discharge channel 4 and further downstream the quench gas supply unit 5 transporting the hot syngas to heat exchangers (not shown) for further cooling. The quench gas supply unit 5 comprises radially extending quench gas supply channels 6 in a circular arrangement coaxial with the discharge channel 4 and the gasifier unit 2. The quench gas supply channels 6 have an open end 7 directed towards the center line X of the discharge channel 4, while their other end is connected to a quench gas supply line 8. From the supply line 8 to the open end 7, the supply channels 6 slope downwardly.

Figure 2:
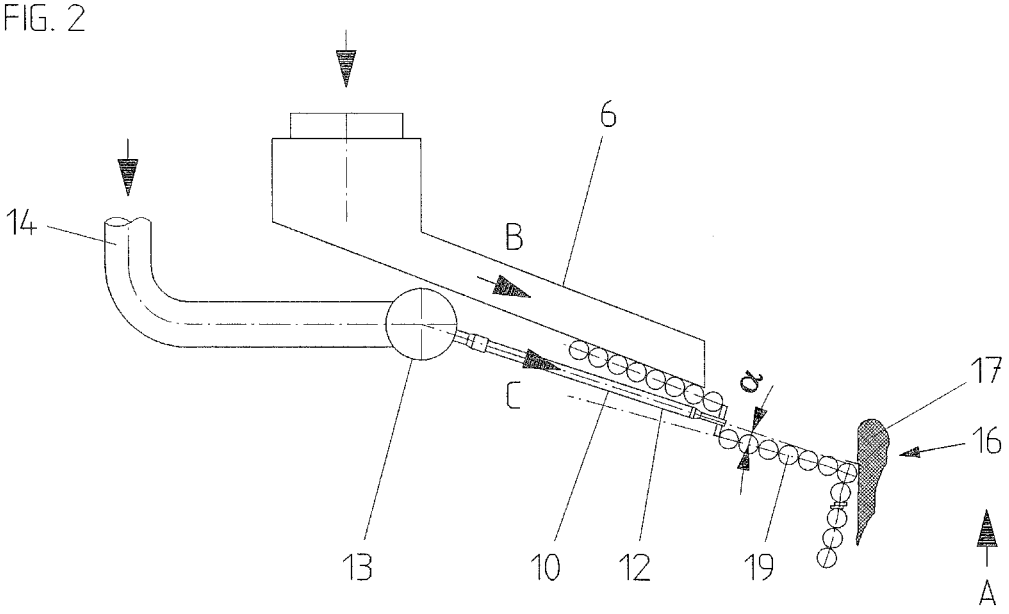
FIG. 2 shows in detail a radial cross section of a quench section of the reactor of FIG. 1.

When the discharged hot syngas is cooled down by the quench gas to a temperature below the softening point of the slag particles, these slag particles are deposited to form upstanding stalagmites 17, as shown in FIG. 2.

Figure 3:
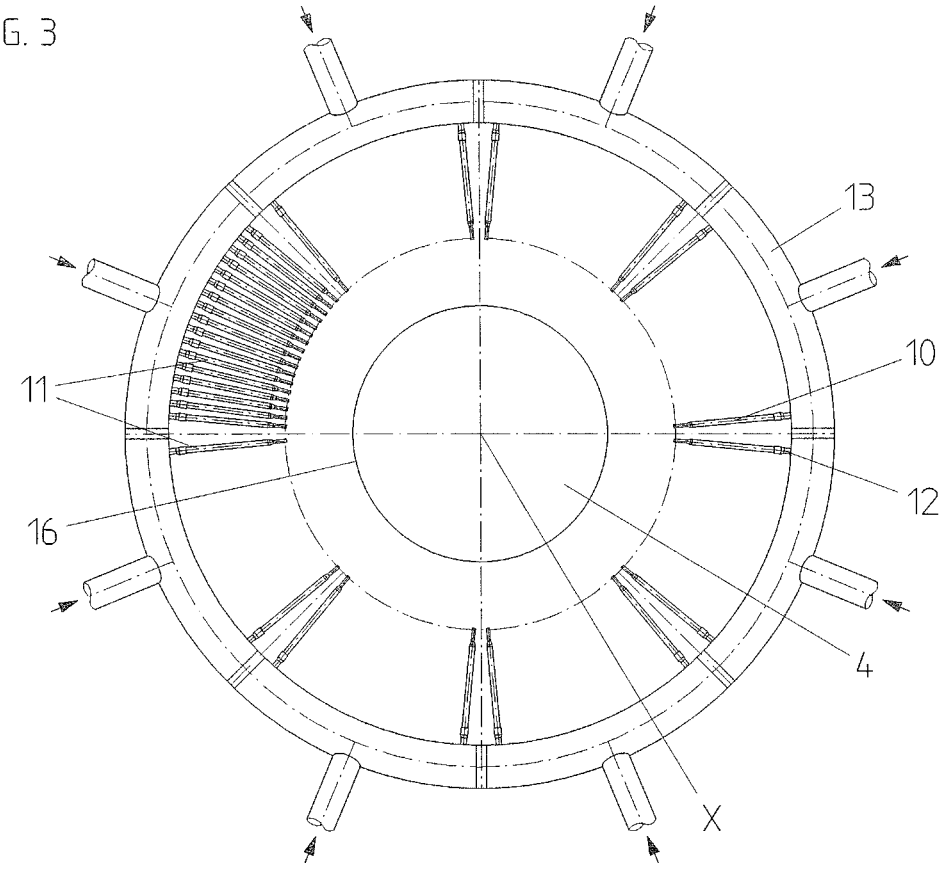
FIG. 3 shows in plan view the quench area of the reactor of FIG. 1.

Near the quench supply unit 6 the reactor 1 is further provided with a blaster 10, as shown in more detail in FIG. 2 and in plan view in FIG. 3. The blaster 10 is built of eight compartments 11. Each compartment 11 comprises a plurality of radially extending blast lances 12. Each blast lance 12 makes an angle of about 2 degrees with the adjacent blast lance 12, resulting in an average distance of about 11 mm.

The blast lances 12 are directed to blast in a direction C (see FIG. 2) in line with the quench flow direction B, so as to blast away slag deposits standing in the way of the quench gas flow B. The blaster 10 is directed to blast under an angle $\alpha$ with the sloping bottom 19 of the quench area 18. The angle $\alpha$ is preferably 0.1-5 degrees.

The slag deposits are particularly formed on the upper peripheral edge 16 at the top end of the gasifier unit 2. When the slag beards are blasted away, they may leave some remaining slag deposit on this peripheral edge 16, which can initiate growth of new slag beards. In order to hinder this, the slag deposits should preferably be blasted away completely without leaving any residue. To this end, the blaster 10 in this embodiment is directed to this upper peripheral edge 16 of the gasifier unit 2.

Each blast lance 12 is connected to a source of pressurized blast gas via a circular distribution line 13 which is connected to a supply line 14. The blast lances can blast the gas with a velocity of 30-300 m/s. The pressure of the blast gas is 10-100 bar higher than the pressure of the discharged syngas. Pairs of opposite compartments 11 are operated symmetrically to mitigate the blast impulse into the center X of the discharged syngas stream.

The blaster 10 is operated periodically to blast away slag deposits around the top end opening of the gasifier unit 2, where the hot syngas is cooled by the quench gas. The blaster 10 further releases a continuous purge flow in addition to the periodically released blast flow.

What is claimed is:

1. A gasification reactor for the production of syngas by gasification of a carbonaceous feed, wherein the reactor comprises:

a gasifier unit with a discharge channel for discharging a stream of slag-loaded hot syngas, the gasifier unit comprising an opening at its top end which opens into the discharge channel;

a quench area forming the beginning of the discharge channel and having a downward sloping bottom around the opening, forming an acute peripheral upper edge of the gasifier unit;

a quench gas supply unit arranged in the quench area and comprising quench gas supply channels for supplying a flow of quench gas into the discharge channel in a quench flow direction, and at least one blaster provided adjacent the quench gas supply unit and comprising a plurality of radially extending blast lances directed to blast in a blast direction in line with the quench flow direction of the quench gas and wherein the plurality of blast lances are directed to the acute peripheral upper edge of the opening for blasting away slag deposits.

2. The gasification reactor according to claim 1 wherein the at least one blaster is connected to a source of pressurized gas selected from the group of syngas, nitrogen, carbon dioxide, steam and mixtures thereof.

3. The gasification reactor according to claim 1, wherein the at least one blaster is arranged to blast the gas with a velocity of 30-300 m/s.

4. The gasification reactor according to claim 1 wherein the blaster is divided into a plurality of compartments, each comprising one or more blast lances, whereby an even number of opposite compartments is operated symmetrically to mitigate the blast impulse into the center of the discharged syngas stream.

5. The gasification reactor according to claim 4, wherein the blaster is divided into 4-16 compartments, each compartment comprising a number of blast lances.

6. The gasification reactor according to claim 1, wherein the quench gas supply unit is located in a quench area with a bottom sloping downwardly to the upper edge of the gasifier unit and wherein the blast lances of the blaster are directed to blast under a blast angle which is 0.1-5 degrees steeper than the sloping bottom of the quench area.

7. The gasification reactor according to claim 1 wherein the blaster comprises a number of blast lances extending in the radial direction of the discharge channel with an angle of 1-3 degrees between adjacent lances.

8. A process for the production of syngas by gasification of a carbonaceous feed in a reactor, the reactor comprising a gasifier unit comprising an opening at its top end which opens into a discharge channel for discharging a stream of slag-loaded hot syngas, and a quench area forming the beginning of the discharge channel and having a downward sloping bottom around the opening, forming an acute peripheral upper edge of the gasifier unit, the process comprising the steps of:

supplying a flow of quench gas into the discharge channel in a quench flow direction using a quench gas supply unit arranged in the quench area and comprising quench gas supply channels, and periodically operating at least one blaster comprising a plurality of blast lances directed in line with the flow direction of the quench gas, the blast lances being directed to the acute peripheral upper edge of the opening of the gasifier unit of the reactor where the gasifier unit opens into the discharge channel.

9. The process according to claim 8 wherein the pressure of the blast gas is 10-100 bar higher than the pressure of the discharged syngas.

10. The process according to claim 8, comprising the step of operating at least a part of the blasters to release a continuous purge flow in addition to the periodically released blast flow.

11. The gasification reactor according to claim 1, the blaster being directed to blast under a blast angle which is 0.1 to 5 degrees steeper than the quench flow direction of the quench gas.

12. The gasification reactor according to claim 11, the quench flow direction of the quench gas being substantially parallel to the sloping bottom of the quench area.

13. The gasification reactor according to claim 1, the quench gas supply channels sloping downwardly.

14. A gasification reactor for the production of syngas by gasification of a carbonaceous feed, the reactor comprising:

a discharge channel;

a gasifier unit to form syngas and having an opening at its top end opening into the discharge channel;

a quench area forming the beginning of the discharge channel, and having a downward sloping bottom around the opening of the gasifier unit, forming an acute peripheral upper edge of the gasifier unit;

a quench gas supply unit arranged in the quench area and comprising radially extending and downward sloping quench gas supply channels having an open end directed towards the center line of the discharge channel while an opposite end is connected to a quench gas supply line for supplying a flow of quench gas into the discharge channel in a quench flow direction which is parallel to the downward sloping bottom of the quench area; and a blaster comprising a plurality of radially extending blast lances for blasting away slag deposits, the blast lances being directed to blast under an angle with respect to the sloping bottom of the quench area and being directed to the acute peripheral upper edge of the opening.

15. The gasification reactor according to claim 14, the plurality of blast lances being offset vertically with respect to the sloping bottom of the quench area, and being arranged at an angle with respect to the sloping bottom; and the quench gas supply channels being offset vertically with respect to the blast lances.

16. The gasification reactor according to claim 15, the sloping bottom of the quench area comprising cooling tubes;

the blast lances being arranged at an angle with respect to the cooling tubes; and other cooling tubes being arranged between the blast lances and the open end of the quench gas supply channels.

17. The gasification reactor of claim 16, an end of the blast lances directed to the acute upper edge being closer to the upper edge than the open ends of adjacent quench gas supply channels.

18. The gasification reactor of claim 14, the blast lances being connected to a circular distribution line which is connected to a source of pressurized blast gas via a supply line.

19. The gasification reactor of claim 14, the blast lances being arranged substantially parallel to the downward sloping quench gas supply channels.

20. The gasification reactor of claim 14, the angle of the blast lances with respect to the sloping bottom of the quench area being in the range of about 0.1 to 5 degrees.

* * * * *